US008568860B2

(12) United States Patent
Maas et al.

(10) Patent No.: US 8,568,860 B2
(45) Date of Patent: Oct. 29, 2013

(54) MULTIWALL POLYMER SHEET COMPRISING BRANCHED POLYCARBONATE

(75) Inventors: Christianus Johannes Jacobus Maas, Rilland (NL); Johann Wagner, Hinterbrühl (AT)

(73) Assignee: Sabic Innovative Plastics IP B.V. (NL)

( * ) Notice: Subject to any disclaimer, the term of this patent is extended or adjusted under 35 U.S.C. 154(b) by 968 days.

(21) Appl. No.: 11/938,504

(22) Filed: Nov. 12, 2007

(65) Prior Publication Data

US 2009/0123719 A1 May 14, 2009

(51) Int. Cl.

| | |
|---|---|
| ***B32B 3/20*** | (2006.01) |
| ***B32B 7/00*** | (2006.01) |
| ***E04C 2/34*** | (2006.01) |
| ***D01D 5/24*** | (2006.01) |

(52) U.S. Cl.

USPC ..... 428/188; 428/120; 428/178; 264/150; 264/209.1; 52/793.1

(58) Field of Classification Search

USPC ..... 428/119, 120, 178, 188; 52/793.1; 264/150, 176.1, 177.1, 209.1

See application file for complete search history.

(56) References Cited

U.S. PATENT DOCUMENTS

| | | | | |
|---|---|---|---|---|
| 3,541,049 | A | | 11/1970 | Cleveland |
| RE27,682 | E | | 6/1973 | Schnell et al. |
| 3,799,953 | A | | 3/1974 | Freitag et al. |
| 4,114,597 | A | * | 9/1978 | Erb ..... 126/665 |
| 4,185,009 | A | | 1/1980 | Idel et al. |
| 4,431,793 | A | | 2/1984 | Rosenquist |
| 4,443,987 | A | * | 4/1984 | Erb ..... 52/309.1 |
| 4,469,861 | A | | 9/1984 | Mark et al. |
| 5,294,472 | A | | 3/1994 | Arnold et al. |
| 5,580,620 | A | * | 12/1996 | Campbell et al. ..... 428/34 |
| 5,776,562 | A | | 7/1998 | Schwarz |
| 5,972,475 | A | * | 10/1999 | Beekman ..... 428/167 |
| 6,339,138 | B1 | | 1/2002 | van Hout et al. |
| 6,365,703 | B1 | | 4/2002 | Day et al. |
| 6,437,083 | B1 | | 8/2002 | Brack et al. |
| 7,256,230 | B2 | | 8/2007 | Fishburn et al. |

(Continued)

FOREIGN PATENT DOCUMENTS

| | | |
|---|---|---|
| DE | 2730469 A1 | 1/1979 |
| EP | 0892121 A | 1/1999 |

(Continued)

OTHER PUBLICATIONS

European Patent No. 0892121; Date of Publication: Jan. 20, 1999; Abstract Only; 1 Page.

(Continued)

*Primary Examiner* — Donald J Loney
(74) *Attorney, Agent, or Firm* — Cantor Colburn LLP

(57) ABSTRACT

Disclosed herein are multiwall sheets and methods for making the same. In one embodiment, a multiwall sheet comprises: main layers and transverse walls. The multiwall sheet comprises: a total thickness of greater than or equal to about 45 mm, a weight of greater than or equal to about 4.5 kg/m$^2$, and/or greater than or equal to about 8 cells and a U-value of less than or equal to about 1.2 W/m$^2$K. The multiwall sheet further comprises greater than 75 wt % branched polycarbonate resin, based upon a total weight of the multiwall sheet.

20 Claims, 4 Drawing Sheets
(3 of 4 Drawing Sheet(s) Filed in Color)

(56) References Cited

U.S. PATENT DOCUMENTS

| | | | | |
|---|---|---|---|---|
| 2004/0191485 | A1* | 9/2004 | Groothues et al. | 428/166 |
| 2004/0229062 | A1 | 11/2004 | Rubeck | |
| 2005/0011145 | A1 | 1/2005 | Mayer et al. | |
| 2005/0048231 | A1 | 3/2005 | Morphet | |
| 2008/0038519 | A1 | 2/2008 | Hoolhorst et al. | |

FOREIGN PATENT DOCUMENTS

| | | | |
|---|---|---|---|
| EP | 0933489 | A | 8/1999 |
| EP | 0705948 | B1 | 5/2000 |
| EP | 0741215 | B1 | 6/2002 |
| EP | 1025321 | B1 | 3/2003 |
| EP | 1055785 | B1 | 3/2005 |

OTHER PUBLICATIONS

International Search Report; International Application No. PCT/IB2008/054724; International Filing Date: Nov. 11, 2008; Date of Mailing: Mar. 5, 2009; 6 Pages.

Written Opinion of the International Search Report; International Application No. PCT/IB2008/054724; International Filing Date: Nov. 11, 2008; Date of Mailing: Mar. 5, 2009; 7 Pages.

European Publication No. EP0741215; Publication Date: Nov. 6, 1996; Abstract Only, 1 page.

European Publication No. EP0705948; Publication Date: Apr. 10, 1996; Abstract Only, 1 page.

* cited by examiner

MULTIWALL POLYMER SHEET COMPRISING BRANCHED POLYCARBONATE

BACKGROUND

In the construction of naturally lit structures (e.g., greenhouses, pool enclosures, conservatories, stadiums, sunrooms, and so forth), glass has been employed in many applications as transparent structural elements, such as, windows, facings, and roofs. However, polymer sheeting is replacing glass in many applications due to several notable benefits.

One benefit of polymer sheeting is that it exhibits excellent impact resistance compared to glass. This in turn reduces maintenance costs in applications wherein occasional breakage caused by vandalism, hail, contraction/expansion, and so forth, is encountered. Another benefit of polymer sheeting is a significant reduction in weight compared to glass. This makes polymer sheeting easier to install than glass and reduces the load-bearing requirements of the structure on which they are installed.

In addition to these benefits, one of the most significant advantages of polymer sheeting is that it provides improved insulative properties compared to glass. This characteristic significantly affects the overall market acceptance of polymer sheeting as consumers desire a structural element with improved efficiency to reduce heating and/or cooling costs.

With current global warming issues, insulation properties of the polymer sheeting are getting more and more important. The trend is to go to higher gauges and multiple layers (e.g., five and more) with air channels in between the layers; all to create a lower U-value (insulation), to save on energy consumption, and thus result in less carbon dioxide ($CO_2$) pollution.

During the production and scale up of these sheets with higher gauges, a processing problem was observed. The heat in the multiwall sheet cannot be sufficiently reduced and/or removed, in the calibrator zone of the extrusion process, resulting in the production of out of specification material with collapsed ribs and/or other issues.

Hence, there is a continuing need for multiwall sheets with reduced collapsed ribs and a process to produce the same.

BRIEF SUMMARY

Disclosed herein are multiwall sheets and methods for making the same. In one embodiment, a multiwall sheet comprises: main layers and transverse walls. The multiwall sheet having a total thickness of greater than or equal to about 45 mm, a weight of greater than or equal to about 4.5 kg/m$^2$, and/or greater than or equal to 8 cells and a U-value of less than or equal to about 1.2 W/m$^2$K. The multiwall sheet further comprises greater than 75 wt % branched polycarbonate resin, based upon the total weight of the sheet.

In another embodiment, a multiwall sheet comprises: main layers, transverse walls, and dividers. The multiwall sheet comprises a total thickness of greater than or equal to about 45 mm, and greater than 75 wt % branched polycarbonate resin, based upon the total weight of the sheet.

In yet another embodiment, a multiwall sheet comprises: main layers, transverse walls, and dividers. The multiwall sheet comprises a weight of greater than or equal to about 4.5 kg/m$^2$, and greater than 75 wt % branched polycarbonate resin, based upon the total weight of the sheet.

In still another embodiment, a multiwall sheet comprises: main layers, transverse walls, and dividers. The multiwall sheet comprises greater than or equal to 8 cells, a U-value of less than or equal to about 1.2 W/m$^2$K, and greater than 75 wt % branched polycarbonate resin, based upon the total weight of the sheet.

In one embodiment, the method of making a multiwall sheet comprises extruding a sheet comprising main layers and transverse walls. The multiwall sheet has a total thickness of greater than or equal to 45 mm, a weight of greater than or equal to 4.5 kg/m$^2$, and/or greater than or equal to 8 cells and a U-value of less than or equal to 1.2 W/m$^2$K. The multiwall sheet further comprises greater than 75 wt % branched polycarbonate resin, based upon the total weight of the sheet.

The above described and other features are exemplified by the following figures and detailed description.

BRIEF DESCRIPTION OF THE DRAWINGS

The patent or application file contains at least one drawing executed in color. Copies of this patent or patent application publication with color drawing(s) will be provided by the Office upon receipt and payment of the necessary fee.

Refer now to the figures, which are exemplary embodiments, and wherein the like elements are numbered alike.

DETAILED DESCRIPTION

Figure 1:
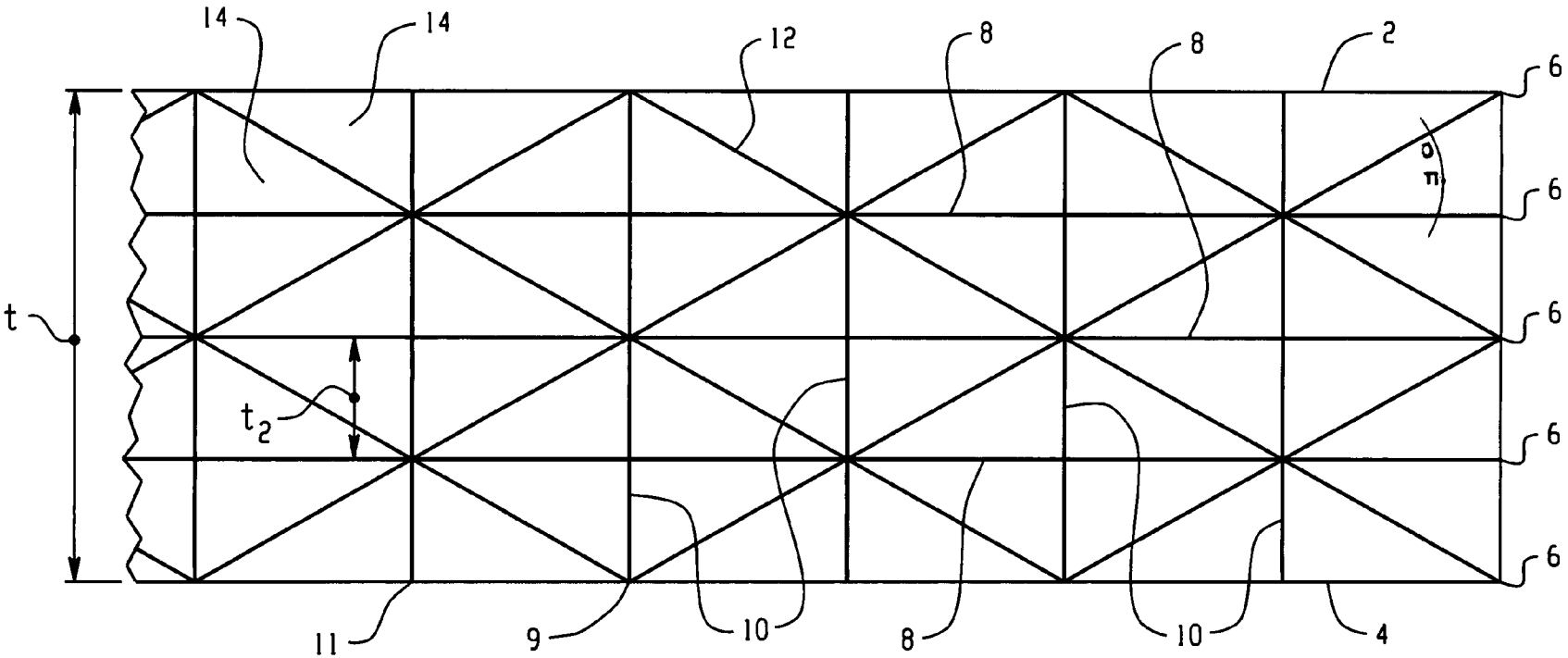
FIG. 1 is a partial cross-sectional view of an exemplary 9 layer multiwall sheet.

In the attempt to meet desired weight, light transmission, and insulation goals, glass has often been replaced with polymer sheeting, and the polymer sheeting has been increasing in thickness and/or the number of sheets. As thicker/heavier/more layered sheets are sought, problems of warping and uneven layers and overall sheet thickness has been encountered. These uneven sheets are not commercially acceptable. As is disclosed herein, the problem of warpage and uneven layers has been addressed. Unexpectedly, it has been discovered that by employing a sufficient amount of branched polycarbonate a straight sheet having: a total thickness of greater than or equal to about 45 mm, a weight of greater than or equal to about 4.5 kg/m$^2$, and/or greater than or equal to 8 cells and a U-value of less than or equal to about 1.2 W/m$^2$K, can be produced.

In one embodiment, the multiwall sheet can comprise main layers and transverse walls. The multiwall sheet can have a total thickness of greater than or equal to 45 mm, a weight of greater than or equal to 4.5 kg/m$^2$, and/or greater than or equal to 8 cells and a U-value of less than or equal to 1.2 W/m$^2$K; as well as greater than 75 wt % branched polycarbonate resin, based upon a total weight of the multiwall sheet. This multiwall sheet can vary by less than or equal to about 2% from an average total thickness, and wherein the average total thickness is determined over an area of 1,200 mm width by 4,200 mm long using at least 10 data points across the width, and/or adjacent main layers can vary by less than or equal to about 20% from an average adjacent layer average thickness wherein the average adjacent layer thickness is determined over an area of the adjacent layers of 1,200 mm width by 4,200 mm long using at least 10 data points across the width. In some embodiments, the sheet varies by less than or equal to about 1.25% from the average total thickness, and/or the adjacent main layers vary by less than or equal to about 15% from the average adjacent layer average thickness. Optionally, the total thickness of the sheet can be greater than or equal to 50 mm, the weight of the sheet can be about 4.5 kg/m$^2$ to about 6.0 kg/m$^2$, and/or the sheet can comprise greater than or equal to 10 cells and the U-value is less than or equal to 1.2 W/m$^2$K. In some embodiments, the branching agent can be chosen from phloroglucin; phloroglucid; 1,1,1-tri(4-hydroxyphenyl)ethane; trimellitic acid; trimellitic trichloride; pyromellitic acid; benzophenonetetracarboxylic acid and acid chlorides thereof; 2,6-bis(2-hydroxy-5-methylbenzyl)-4-methylphenol and 1,3,5-tri(4-hydroxyphenyl)benzene, and combinations comprising at least one of the foregoing branching agents, e.g., 1,1,1-tri(4-hydroxyphenyl)ethane and/or trimellitic trichloride. Furthermore, the branched polycarbonate can comprise greater than or equal to 0.3 mol % branching, based upon 100 moles of branched polycarbonate, or, specifically, about 0.3 mol % to about 0.5 mol % branching, based upon 100 moles of branched polycarbonate. In some embodiments, the weight can be greater than or equal to about 5.0 kg/m$^2$, and/or the multiwall sheet comprises 98 wt % branched polycarbonate resin.

In one embodiment, a method for producing a multiwall sheet comprises: extruding polycarbonate resin to form the multiwall sheet having main layers and transverse walls. The multiwall sheet can have a total thickness of greater than or equal to 45 mm, a weight of greater than or equal to 4.5 kg/m$^2$, and/or greater than or equal to 8 cells and a U-value of less than or equal to 1.2 W/m$^2$K; and greater than 75 wt % branched polycarbonate resin, based upon a total weight of the multiwall sheet.

In one embodiment, the multiwall sheet comprises greater than 75 wt % branched polycarbonate resin, or specifically, greater than or equal to about 85 wt % branched polycarbonate resin, or more specifically, greater than or equal to about 90 wt % branched polycarbonate resin, and yet more specifically, about 98 wt % branched polycarbonate resin, based upon a total weight of the sheet, with, for example, greater than or equal to about 0.3 mole % branching. The sheet has a total thickness of greater than or equal to about 45 millimeters (mm); a weight of greater than or equal to about 4.5 kilograms per square meter (kg/m$^2$); and/or greater to 8 to about 4.5 kilograms per square meter (kg/m$^2$); and/or greater than or equal to 8 cells (e.g., greater than or equal to five horizontal layers and greater than or equal to four dividers) and a U-value of less than or equal to about 1.2 watts per square meter Kelvin (W/m$^2$K).

In one embodiment, the multiwall sheet can comprise sufficient horizontal walls and transverse walls (e.g., walls that intersect the horizontal walls), and dividers (walls that split the areas formed between adjacent horizontal walls and transverse walls) to produce greater than or equal to 8 cells (e.g., air channels, liquid reservoirs, and so forth), or, specifically, greater than or equal to 10 cells, or, more specifically, greater than or equal to 14 cells, and, yet more specifically, greater than or equal to 18 cells. As used therein, the number of cells is the amount of cells located between the outerwalls and adjacent traverse walls. For example, referring to FIG. 1, there are 8 cells located between outerwalls 2,4, and adjacent transverse walls 9,11.

Additionally, the sheet has a sufficient number of transverse layers to attain the desired structural integrity. In addition to the main layers and the transverse layers, dividers can be employed. The dividers can have various geometries such as vertical (e.g., perpendicular), horizontal, a cross (e.g., X) geometry, a sinusoidal geometry, as well as any other geometry and combinations comprising at least one of these geometries.

To be specific, the U-value is the amount of thermal energy that passes across 1 square meter of the sheet 2 at a temperature difference between both sheet sides of 1 K. The U-value can be determined according to EN 675 and Deutches Institute fur Normung ("DIN") European Norm ("EN") 12667/12664. The U-value is calculated according to the following Formula (I):

$$U = \frac{1}{1/\alpha_i + 1/\chi + 1/\alpha_a} \quad \text{(I)}$$

wherein: $\chi=\lambda/s$ $\lambda$=thermal conductivity s=sheet thickness $(1/\alpha_i)$=thermal transition resistance value inside $(1/\alpha_a)$=thermal transition resistance value outside According to NEN 1068 (year 2001) the values of $(1/\alpha_i)$ is 0.13 (m$^2$ K/W) and for of $(1/\alpha_a)$ is 0.04 (m$^2$ K/W) and is independent of type of polymer. The thermal conductivity is normally measured empirically for the specific structure.

It has been discovered that multiwall sheets having a total thickness of greater than or equal to about 45 millimeters (mm); a weight of greater than or equal to about 4.5 kg/m$^2$; and/or greater than or equal to 8 cells with a U value of less than or equal to about 1.2 W/m$^2$K, generally have defects. These defects can include unevenly divided air channels, broken rib(s), non-straight rib(s), collapsed rib(s), and so forth. However, when these wall(s) comprise greater than or equal to about 90 wt % branched polycarbonate resin, and particularly about 100 wt % branched polycarbonate (based upon the total weight of the multiwall sheet), the defects are reduced and often eliminated. In other words, the multiwall sheet can be produced within specifications.

In some embodiments, the specific polymer chosen will be capable of providing sufficient light transmission for the intended application. For example, the polymer can provide a transmission of visible light of greater than or equal to about 40%, or, more specifically, greater than or equal to about 45%, even more specifically, greater than or equal to about 50%, as tested per EN9050 ASTM D1003 00 (Procedure B, Spectrophotometer, using illuminant C with diffuse illumination and unidirectional viewing). Transmission is defined as:

$$\%T = \left(\frac{I}{I_O}\right) \times 100\% \quad \text{(II)}$$

wherein: I=intensity of the light passing through the test sample $I_O$=Intensity of incident light The composition of the multiwall sheet comprises branched polycarbonate. "Polycarbonates" as used herein include homopolycarbonates, copolymers comprising different $R^1$ moieties in the carbonate (referred to herein as "copolycarbonates"), copolymers comprising carbonate units and other types of polymer units, such as ester units, and combinations comprising at least one of homopolycarbonates and copolycarbonates; wherein the term "polycarbonate" means compositions having repeating structural carbonate units of Formula (1):

(1)

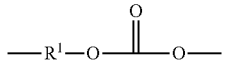

in which at least about 60 percent of the total number of $R^1$ groups contain aromatic moities and the balance thereof are aliphatic, alicyclic, or aromatic. In an embodiment, each $R^1$ is a $C_{6-30}$ aromatic group, that is, contains at least one aromatic moiety. $R^1$ can be derived from a dihydroxy compound of the formula HO—$R^1$—OH, in particular of Formula (2):

$$HO—A^1—Y^1—A^2—OH \quad (2)$$

wherein each of $A^1$ and $A^2$ is a monocyclic divalent aromatic group and $Y^1$ is a single bond or a bridging group having one or more atoms that separate $A^1$ from $A^2$. In an exemplary embodiment, one atom separates $A^1$ from $A^2$. Specifically, each $R^1$ can be derived from a dihydroxy aromatic compound of Formula (3)

(3)

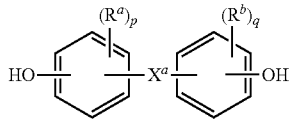

wherein $R^a$ and $R^b$ each represent a halogen or $C_{1-12}$ alkyl group and can be the same or different; and p and q are each independently integers of 0 to 4. It will be understood that $R^a$ is hydrogen when p is 0, and likewise $R^b$ is hydrogen when q is 0. Also in formula (3), $X^a$ represents a bridging group connecting the two hydroxy-substituted aromatic groups, where the bridging group and the hydroxy substituent of each $C_6$ arylene group are disposed ortho, meta, or para (specifically para) to each other on the $C_6$ arylene group. In an embodiment, the bridging group $X^a$ is single bond, —O—, —S—, —S(O)—, —$S(O)_2$—, —C(O)—, or a $C_{1-18}$ organic group. The $C_{1-18}$ organic bridging group can be cyclic or acyclic, aromatic or non-aromatic, and can further comprise heteroatoms such as halogens, oxygen, nitrogen, sulfur, silicon, or phosphorous. The $C_{1-18}$ organic group can be disposed such that the $C_6$ arylene groups connected thereto are each connected to a common alkylidene carbon or to different carbons of the $C_{1-18}$ organic bridging group. In one embodiment, p and q is each 1, and $R^a$ and $R^b$ are each a $C_{1-3}$ alkyl group, specifically methyl, disposed meta to the hydroxy group on each arylene group.

In an embodiment, $X^a$ is a substituted or unsubstituted $C_{3-18}$ cycloalkylidene, a $C_{1-25}$ alkylidene of formula —C($R^c$)($R^d$)— wherein $R^c$ and $R^d$ are each independently hydrogen, $C_{1-12}$ alkyl, $C_{1-12}$ cycloalkyl, $C_{7-12}$ arylalkyl, $C_{1-12}$ heteroalkyl, or cyclic $C_{7-12}$ heteroarylalkyl, or a group of the formula —C(=$R^e$)— wherein $R^e$ is a divalent $C_{1-12}$ hydrocarbon group. Exemplary groups of this type include methylene, cyclohexylmethylene, ethylidene, neopentylidene, and isopropylidene, as well as 2-[2.2.1]-bicycloheptylidene, cyclohexylidene, cyclopentylidene, cyclododecylidene, and adamantylidene. A specific example wherein $X^a$ is a substituted cycloalkylidene is the cyclohexylidene-bridged, alkyl-substituted bisphenol of Formula (4)

(4)

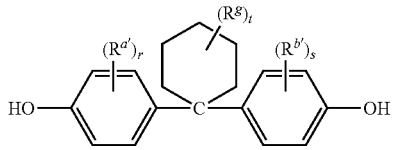

wherein $R^{a'}$ and $R^{b'}$ are each independently $C_{1-12}$ alkyl, $R^g$ is $C_{1-12}$ alkyl or halogen, r and s are each independently 1 to 4, and t is 0 to 10. In a specific embodiment, at least one of each of $R^{a'}$ and $R^{b'}$ are disposed meta to the cyclohexylidene bridging group. The substituents $R^{a'}$, $R^{b'}$, and $R^g$ may, when comprising an appropriate number of carbon atoms, be straight chain, cyclic, bicyclic, branched, saturated, or unsaturated. In an embodiment, $R^{a'}$ and $R^{b'}$ are each independently $C_{1-4}$ alkyl, $R^g$ is $C_{1-4}$ alkyl, r and s are each 1, and t is 0 to 5. In another specific embodiment, $R^{a'}$, $R^{b'}$ and $R^g$ are each methyl, r and s are each 1, and t is 0 or 3. The cyclohexylidene-bridged bisphenol can be the reaction product of two moles of o-cresol with one mole of cyclohexanone. In another exemplary embodiment, the cyclohexylidene-bridged bisphenol is the reaction product of two moles of a cresol with one mole of a hydrogenated isophorone (e.g., 1,1,3-trimethyl-3-cyclohexane-5-one). Such cyclohexane-containing bisphenols, for example the reaction product of two moles of a phenol with one mole of a hydrogenated isophorone, are useful for making polycarbonate polymers with high glass transition temperatures and high heat distortion temperatures. Cyclohexyl bisphenol-containing polycarbonates, or a combination comprising at least one of the foregoing with other bisphenol polycarbonates, are supplied by Bayer Co. under the APEC® trade name.

In another embodiment, $X^a$ is a $C_{1-18}$ alkylene group, a $C_{3-18}$ cycloalkylene group, a fused $C_{6-18}$ cycloalkylene group, or a group of the formula —$B^1$—W—$B^2$— wherein $B^1$ and $B^2$ are the same or different $C_{1-6}$ alkylene group and W is a $C_{3-12}$ cycloalkylidene group or a $C_{6-16}$ arylene group.

$X^a$ can also be a substituted $C_{3-18}$ cycloalkylidene of Formula (5):

(5)

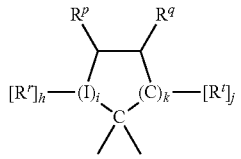

wherein $R^r$, $R^p$, $R^q$, and $R^t$ are independently hydrogen, halogen, oxygen, or $C_{1-12}$ organic groups; I is a direct bond, a carbon, or a divalent oxygen, sulfur, or —N(Z)— where Z is hydrogen, halogen, hydroxy, $C_{1-12}$ alkyl, $C_{1-12}$ alkoxy, or $C_{1-12}$ acyl; h is 0 to 2, j is 1 or 2, i is an integer of 0 or 1, and k is an integer of 0 to 3, with the proviso that at least two of $R^r$, $R^p$, $R^q$, and $R^t$ taken together are a fused cycloaliphatic, aromatic, or heteroaromatic ring. It will be understood that where the fused ring is aromatic, the ring as shown in Formula (5) will have an unsaturated carbon-carbon linkage where the ring is fused. When k is one and i is 0, the ring as shown in formula (5) contains 4 carbon atoms, when k is 2, the ring as shown in formula (5) contains 5 carbon atoms, and when k is 3, the ring contains 6 carbon atoms. In one embodiment, two adjacent groups (e.g., $R^q$ and $R^t$ taken together) form an aromatic group, and in another embodiment, $R^q$ and $R^t$ taken together form one aromatic group and $R^r$ and $R^p$ taken together form a second aromatic group. When $R^q$ and $R^t$ taken together form an aromatic group, $R^p$ can be a double-bonded oxygen atom, i.e., a ketone.

Other useful aromatic dihydroxy compounds of the formula HO—$R^1$—OH include compounds of Formula (6)

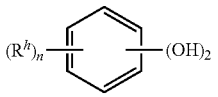

(6)

wherein each $R^h$ is independently a halogen atom, a $C_{1-10}$ hydrocarbyl such as a $C_{1-10}$ alkyl group, a halogen-substituted $C_{1-10}$ alkyl group, a $C_{6-10}$ aryl group, or a halogen-substituted $C_{6-10}$ aryl group, and n is 0 to 4. The halogen is usually bromine.

Some illustrative examples of specific aromatic dihydroxy compounds include the following: 4,4'-dihydroxybiphenyl, 1,6-dihydroxynaphthalene, 2,6-dihydroxynaphthalene, bis(4-hydroxyphenyl)methane, bis(4-hydroxyphenyl)diphenylmethane, bis(4-hydroxyphenyl)-1-naphthylmethane, 1,2-bis(4-hydroxyphenyl)ethane, 1,1-bis(4-hydroxyphenyl)-1-phenylethane, 2-(4-hydroxyphenyl)-2-(3-hydroxyphenyl)propane, bis(4-hydroxyphenyl)phenylmethane, 2,2-bis(4-hydroxy-3-bromophenyl)propane, 1,1-bis(hydroxyphenyl)cyclopentane, 1,1-bis(4-hydroxyphenyl)cyclohexane, 1,1-bis(4-hydroxyphenyl)isobutene, 1,1-bis(4-hydroxyphenyl)cyclododecane, trans-2,3-bis(4-hydroxyphenyl)-2-butene, 2,2-bis(4-hydroxyphenyl)adamantane, alpha, alpha'-bis(4-hydroxyphenyl)toluene, bis(4-hydroxyphenyl)acetonitrile, 2,2-bis(3-methyl-4-hydroxyphenyl)propane, 2,2-bis(3-ethyl-4-hydroxyphenyl)propane, 2,2-bis(3-n-propyl-4-hydroxyphenyl)propane, 2,2-bis(3-isopropyl-4-hydroxyphenyl)propane, 2,2-bis(3-sec-butyl-4-hydroxyphenyl)propane, 2,2-bis(3-t-butyl-4-hydroxyphenyl)propane, 2,2-bis(3-cyclohexyl-4-hydroxyphenyl)propane, 2,2-bis(3-allyl-4-hydroxyphenyl)propane, 2,2-bis(3-methoxy-4-hydroxyphenyl)propane, 2,2-bis(4-hydroxyphenyl)hexafluoropropane, 1,1-dichloro-2,2-bis(4-hydroxyphenyl)ethylene, 1,1-dibromo-2,2-bis(4-hydroxyphenyl)ethylene, 1,1-dichloro-2,2-bis(5-phenoxy-4-hydroxyphenyl)ethylene, 4,4'-dihydroxybenzophenone, 3,3-bis(4-hydroxyphenyl)-2-butanone, 1,6-bis(4-hydroxyphenyl)-1,6-hexanedione, ethylene glycol bis(4-hydroxyphenyl)ether, bis(4-hydroxyphenyl)ether, bis(4-hydroxyphenyl)sulfide, bis(4-hydroxyphenyl)sulfoxide, bis(4-hydroxyphenyl)sulfone, 9,9-bis(4-hydroxyphenyl)fluorine, 2,7-dihydroxypyrene, 6,6'-dihydroxy-3,3,3',3'-tetramethylspiro(bis)indane ("spirobiindane bisphenol"), 3,3-bis(4-hydroxyphenyl)phthalimide, 2,6-dihydroxydibenzo-p-dioxin, 2,6-dihydroxythianthrene, 2,7-dihydroxyphenoxathin, 2,7-dihydroxy-9,10-dimethylphenazine, 3,6-dihydroxydibenzofuran, 3,6-dihydroxydibenzothiophene, and 2,7-dihydroxycarbazole, resorcinol, substituted resorcinol compounds such as 5-methyl resorcinol, 5-ethyl resorcinol, 5-propyl resorcinol, 5-butyl resorcinol, 5-t-butyl resorcinol, 5-phenyl resorcinol, 5-cumyl resorcinol, 2,4,5,6-tetrafluoro resorcinol, 2,4,5,6-tetrabromo resorcinol, or the like; catechol; hydroquinone; substituted hydroquinones such as 2-methyl hydroquinone, 2-ethyl hydroquinone, 2-propyl hydroquinone, 2-butyl hydroquinone, 2-t-butyl hydroquinone, 2-phenyl hydroquinone, 2-cumyl hydroquinone, 2,3,5,6-tetramethyl hydroquinone, 2,3,5,6-tetra-t-butyl hydroquinone, 2,3,5,6-tetrafluoro hydroquinone, 2,3,5,6-tetrabromo hydroquinone, and the like, as well as combinations comprising at least one of the foregoing dihydroxy compounds.

Specific examples of bisphenol compounds of formula (3) include 1,1-bis(4-hydroxyphenyl) methane, 1,1-bis(4-hydroxyphenyl)ethane, 2,2-bis(4-hydroxyphenyl)propane (hereinafter "bisphenol A" or "BPA"), 2,2-bis(4-hydroxyphenyl)butane, 2,2-bis(4-hydroxyphenyl)octane, 1,1-bis(4-hydroxyphenyl)propane, 1,1-bis(4-hydroxyphenyl)n-butane, 2,2-bis(4-hydroxy-1-methylphenyl)propane, 1,1-bis(4-hydroxy-t-butylphenyl)propane, 3,3-bis(4-hydroxyphenyl)phthalimidine, 2-phenyl-3,3-bis(4-hydroxyphenyl)phthalimidine (PPPBP), and 1,1-bis(4-hydroxy-3-methylphenyl)cyclohexane (DMBPC). Combinations comprising at least one of the foregoing dihydroxy compounds can also be used. In one specific embodiment, the polycarbonate is a linear homopolymer derived from bisphenol A, in which each of $A^1$ and $A^2$ is p-phenylene and $Y^1$ is isopropylidene in Formula (3).

The polycarbonates can have an intrinsic viscosity, as determined in chloroform at 25° C., of about 0.3 to about 1.5 deciliters per gram (dl/gm), specifically about 0.45 to about 1.0 dl/gm. The polycarbonates can have a weight average molecular weight (Mw) of about 10,000 grams per mole (g/mol) to about 200,000 g/mol, specifically about 20,000 g/mol to about 100,000 g/mol. Unless set forth otherwise, all weight average molecular weight is as measured by gel permeation chromatography (GPC), using a crosslinked styrene-divinylbenzene column and calibrated to polycarbonate references. GPC samples are prepared at a concentration of about 1 mg/ml, and are eluted at a flow rate of about 1.5 ml/min. In some embodiments of the multiwall sheets herein, the branched polycarbonate can have a weight average molecular weight of less than or equal to about 75,000 g/mole, or, specifically, about 24,000 g/mol to about 50,000 g/mol, or, more specifically, about 28,000 g/mol to about 35,000 g/mol, and, yet more specifically, about 32,000 g/mol to about 34,000 g/mol. The linear polycarbonate, e.g., that can be combined with the branched polycarbonate, can have a weight average molecular weight of less than or equal to about 50,000 g/mole, or, specifically, about 20,000 g/mol to about 50,000 g/mol, or, more specifically, about 26,000 g/mol to about 35,000 g/mol, and, yet more specifically, about 28,000 g/mol to about 32,000 g/mol.

In one embodiment, the branched polycarbonate has flow properties useful for the manufacture of thin articles. The branched polycarbonate can have a melt index ratio (MIR) of about 1.5 to about 2, or, specifically, about 1.7 to about 1.9, or, more specifically, about 1.75 to about 1.85, over a period of time of greater than or equal to 10 minutes as is determined in accordance with ASTM D1238-04.

$$MIR = \left(\frac{MVR \text{ using a 21.6 kg weight and 300° C.}}{MVR \text{ using a 2.16 kg weight and 300° C.}}\right)$$

wherein: MVR is the melt volume rate kg is kilograms

Branched polycarbonate blocks can be prepared by adding a branching agent during polymerization. These branching agents include polyfunctional organic compounds containing at least three functional groups selected from hydroxyl, carboxyl, carboxylic anhydride, haloformyl, and mixtures of the foregoing functional groups. Specific examples include trimellitic acid; trimellitic anhydride; trimellitic trichloride (TMTC); tris-p-hydroxy phenyl ethane (e.g., 1,1,1-tri(4-hydroxyphenyl)ethane (THPE)); isatin-bis-phenol; tris-phenol TC(1,3,5-tris((p-hydroxyphenyl)isopropyl)benzene); 1,3,5-tri(4-hydroxyphenyl)benzene; tris-phenol PA(4(4(1,1-bis(p-hydroxyphenyl)-ethyl) alpha, alpha-dimethyl benzyl)phenol); 4-chloroformyl phthalic anhydride; trimesic acid; benzophenone tetracarboxylic acid and acid chlorides thereof; phloroglucin; phloroglucid; 1,1,1-tri(4-hydroxyphenyl)ethane (THPE); (TMTC); pyromellitic acid; and 2,6-bis (2-hydroxy-5-methylbenzyl)-4-methylphenol. In order to attain enhanced weathering performance, and especially ultraviolet radiation weathering performance, THPE and/or TMTC are employed.

The branching agents can be added at a level of less than or equal to about 3.0 wt %, or, specifically, about 0.05 to about 2.0 wt %, based upon a total weight of the polycarbonate precursors. The amount of branching agents employed is based upon the desired degree of branching attained in the final branched polycarbonate. The branching can be sufficient to attain the desired multiwall sheet (e.g., such as that described and illustrated in relation to FIG. 5), while maintaining impact properties, desired light transmission, and processability. In some embodiments, the branched polycarbonate has greater than or equal to about 0.3 mole percent (mol %) branching, or, specifically, about 0.3 mol % to about 0.5 mol % branching, or, more specifically, about 0.35 mol % to about 0.45 mol % branching, based upon 100 moles of branched polycarbonate.

The number of layers of the multiwall sheet is dependent upon customer requirements such as structural integrity, overall thickness, light transmission properties, insulative properties, and overall weight. In one embodiment, the multiwall sheet can comprise horizontal walls and transverse walls, the overall multiwall sheet thickness is greater than or equal to about 45 mm, or, specifically, greater than or equal to about 50 mm, or, more specifically, greater than or equal to about 55 mm, and, yet more specifically, greater than or equal to about 60 mm. For example, the overall multiwall sheet thickness (t) can be about 45 mm to about 65 mm. (See FIG. 1)

In some applications, the various walls and dividers can have different thicknesses. For example, the outer walls can have a greater thickness than the inner walls (e.g., longitudinal layers), while the transverse layers have a thickness between the outer wall thickness and the inner walls thickness. For example, the outer walls can have a thickness of about 0.6 mm to about 2 mm, or, specifically, about 0.75 mm to about 1.2 mm, or, yet more specifically, about 0.8 mm to 1.0 mm; the inner wall(s) can have a thickness of about 0.05 mm to about 0.30 mm, or, specifically, about 0.075 mm to about 0.15 mm, or, yet more specifically, about 0.075 mm to 0.125 mm; and the transverse wall(s) can have a thickness of about 0.2 mm to about 1.0 mm, or, specifically, about 0.25 mm to about 0.75 mm, or, yet more specifically, about 0.4 mm to 0.6 mm. In some applications, the outer walls have a thickness that is greater than or equal to about 125% of the transverse wall thickness, while the inner walls have a thickness that is less than or equal to about 50% of the transverse wall thickness. Dividers, which can have a thickness that is greater than the inner wall thickness, can have a thickness that is less than or equal to about 50% of the transverse wall thickness. For example, the dividers can have a thickness of about 0.05 mm to about 0.30 mm, or, specifically, about 0.075 mm to about 0.175 mm, or, yet more specifically, about 0.10 mm to about 0.15 mm.

In one embodiment, the multiwall sheet can comprise a weight of greater than or equal to about 4.5 kg/m$^2$, or, specifically, greater than or equal to about 5.0 kg/m$^2$, or, more specifically, greater than or equal to about 5.5 kg/m$^2$. For example, the multiwall sheet can have a weight of about 4.5 kg/m$^2$ to about 6.0 kg/m$^2$.

Figure 2:
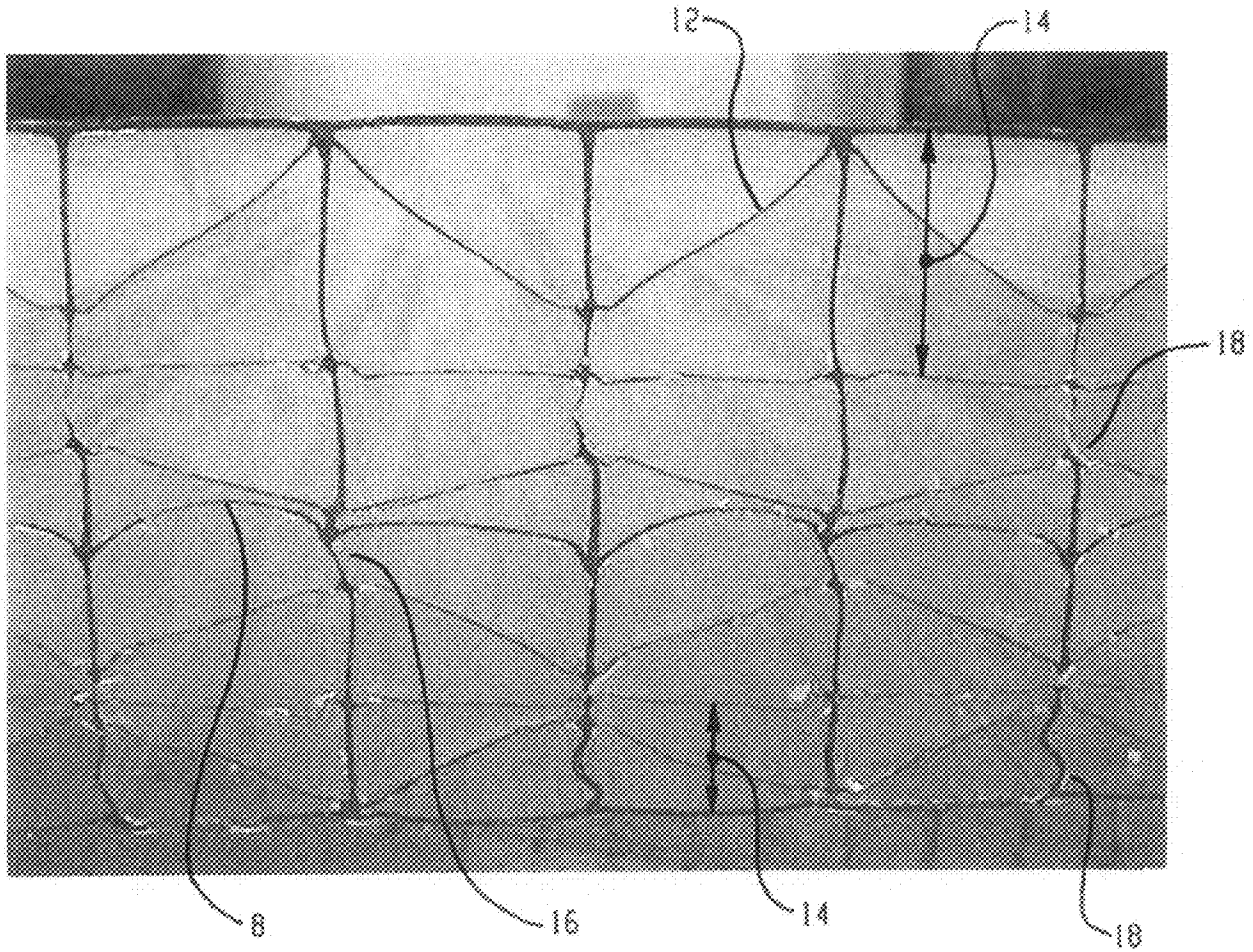
FIG. 2 is a picture of a partial cross-sectional view 55 mm, 9 layer, multiwall sheet comprising 100 wt % linear polycarbonate.
Figure 3:
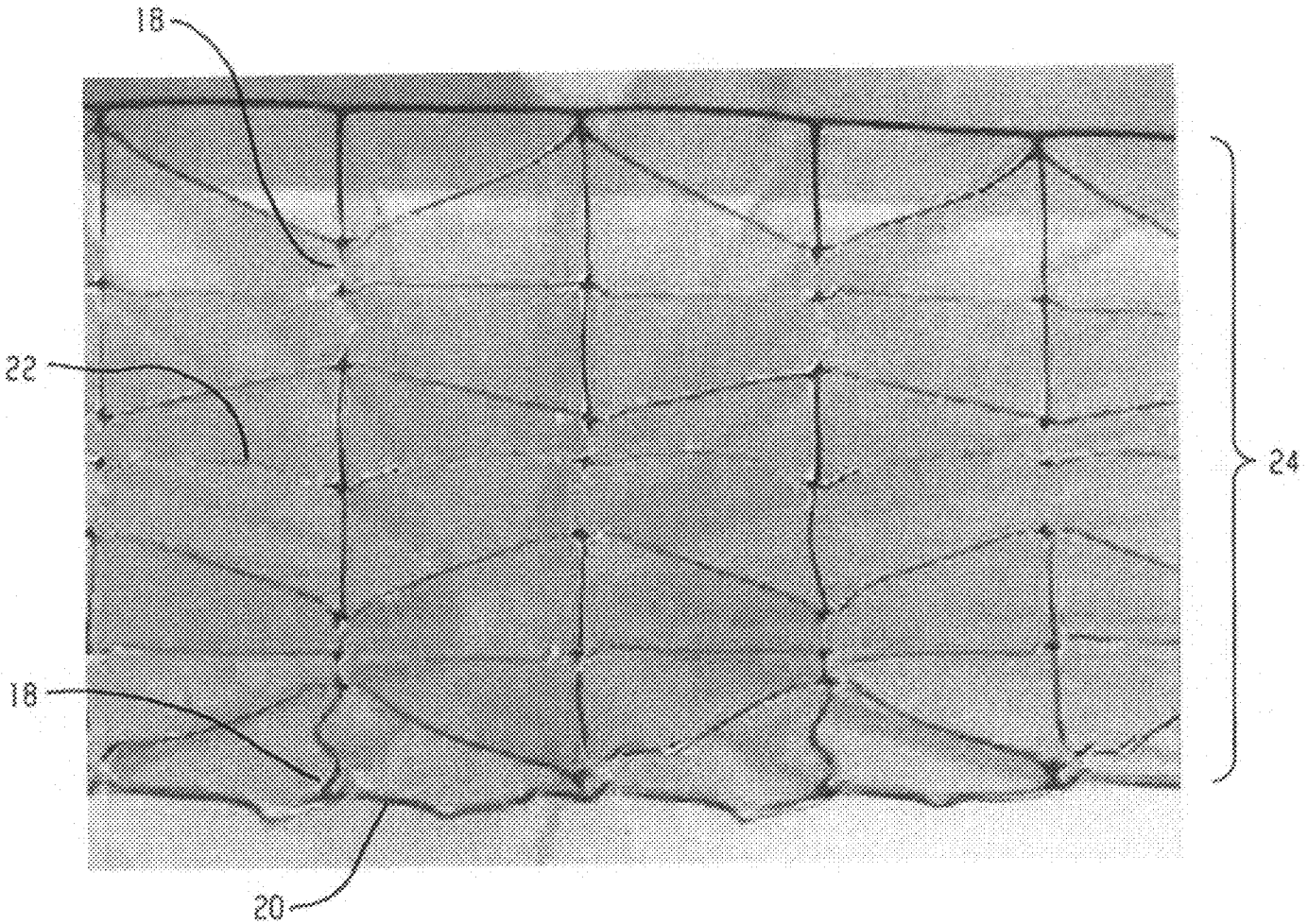
FIG. 3 is a picture of a partial cross-sectional view 55 mm, 9 layer, multiwall sheet comprising 75 wt % branched polycarbonate with 0.3 mol % branching, balance linear polycarbonate.
Figure 4:
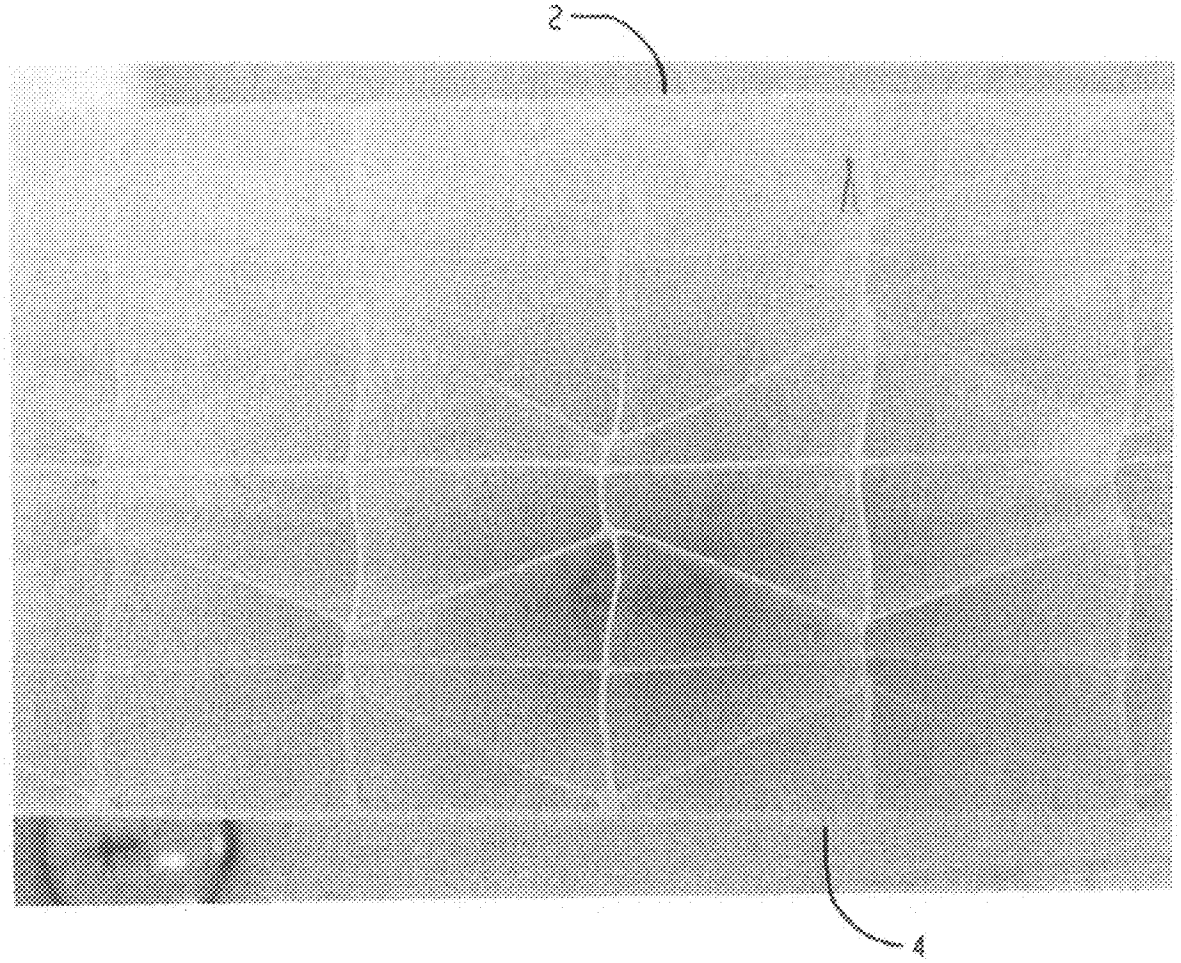
FIG. 4 is a picture of a partial cross-sectional view 55 mm, 9 layer, multiwall sheet comprising 100 wt % branched polycarbonate with 0.3 mol % branching.

Referring to FIG. 1, a portion of a multiwall sheet is illustrated having five main layers 6 comprising outer walls 2,4 and inner walls 8. The sheet also has transverse walls 10 and dividers 12. Desirably, each wall and divider has a uniform thickness along its length. The main layers 6 are disposed parallel to one another while the transverse walls 10 are disposed perpendicular to the main layers 6. In this embodiment, the dividers 12 bisect the channels 14 formed by the main walls 6 and the transverse walls 10. The illustrated multiwall sheet has 5 layers with diagonal dividers 12. This sheet is illustrative of the sheet that is desired in the extrusion process having an overall thickness of 55 mm and a U-value of 1 W/m2K. FIGS. 2-4 illustrate the results of forming the multiwall sheet illustrated in FIG. 1 having 9 layers and using different materials (e.g., 100 wt % linear polycarbonate, 75 wt % branched polycarbonate, and 100 wt % branched polycarbonate, respectively, based upon a total weight of the sheet).

As can be seen in FIG. 2, a 55 mm, 9 layer multiwall sheet (i.e., 5 main layers and 4 dividers) comprising 100% linear polycarbonate exhibited several of the defects identified above. As can be seen, the dividers 12 failed to produce evenly divided channels 14. The inner walls 8, instead of being uniform and straight, had a curved geometry and non-uniform thickness. Transverse walls 10 comprised "broken portions" where the wall separated forming a gap, and collapsed portions 18 where the transverse wall 10 was non-linear, forming a bend, and having a non-uniform thickness along the length of the wall. As a result of these defects, unacceptable distortion occurred at a load of 1,000 Newtons per square meter (N/m$^2$), while such a sheet should be capable of withstanding a load of 2,000 N/m$^2$. Additionally, buckling of the sheet occurred at a load of 2,000 N/m$^2$, while buckling on such a sheet (i.e., thickness, number of layers, etc.) should only occur at a load of 3,500 N/m$^2$. Additionally, the aesthetic qualities were poor (e.g., the layers are not straight, the dividers are bowed, etc.). Hence, the quality was unacceptable for commercial use.

The multiwall sheet of FIG. 4 comprising 100 wt % branched polycarbonate (having 0.3 mol % branching), has no collapsed portions (e.g., dividers (ribs), or transverse walls), evenly divided channels, and no breaks in the ribs. For example, the vertical ribs can have a constant distance to each other of about 20 mm ±3 mm and the horizontal ribs can have a constant distance to each other of about 13 mm ±3 mm. Additionally, the main layers are substantially straight. This multiwall sheet had a U-value of 0.95 W/m$^2$K; it was acceptable for commercial use.

"Straightness" as used herein is determined by averaging the thickness (of the whole sheet for the overall straightness, and of adjacent layers to determine the straightness of individual layers). The average is taken over an area of 1,200 mm width by 4,200 mm long. At least 10 data points across the width are used to determine the average. Then, for the overall sheet to be straight, the overall thickness ("t") at any point on the sheet varies by less than or equal to about 2% from the average thickness. For example, if the average thickness is 45 mm, for the sheet to be considered straight, the thickness at any point across the sheet will be 44.1 mm to 45.9 mm. Desirably, the thickness at any point on the sheet varies by less than or equal to about 1.5% from the average thickness, or, specifically, by less than or equal to about 1.25%. For adjacent layers, a straight layer will vary by less than or equal to about 20%. Desirably, adjacent layers vary in thickness ("$t_2$") by less than or equal to about 15%, or, specifically, by less than or equal to about 10%, compared to the average thickness.

Each channel can contain a fluid (i.e., gas (e.g., air) and/or liquid); e.g., some of the areas of the sheet can be filled with liquid while others can be free of liquid. The liquid introduced to the sheet can be any liquid that has the desired transmission properties (e.g., transparent to visible light (for example, has a transmission of greater than or equal to about 95%), and desirably, less transparent (or opaque) to direct solar light), and does not react with the layer material(s). Possible liquids include water (e.g., demineralized water, water having a neutral pH (e.g., pH of about 6.5 to about 7.5), as well as combinations comprising at least one of these properties), glycerin, polydimethylsiloxane oil, transparent gels, and so forth, as well as combinations comprising at least one of the foregoing. Depending upon the environmental conditions that will affect the sheet (and hence the liquid), additive(s) can be mixed with the liquid, such as anti-freeze additives (e.g., to prevent freezing in the winter), antimicrobial agents, and so forth, as well as combinations comprising at least one of the foregoing.

Multiwall sheets having a weight of greater than or equal to 4.5 kg/m$^2$ a total thickness of greater than or equal to about 45 mm, and/or greater than or equal to 8 cells and a U-value of less than or equal to about 1.2 W/m$^2$K, will have a variation in thickness of adjacent horizontal layers of greater than 25%, generally greater than 30%, and even up to 45%, compared to the average thickness. With respect to the overall thickness variation, it is greater than 5% compared to the average overall thickness. Such variations are unacceptable for commercial use.

Employing greater than 75 wt % branched polycarbonate, or, specifically, greater than about 90 wt % branched polycarbonate, and more specifically, greater than or equal to about 98 wt % branched polycarbonate, and yet more specifically, about 100 wt % branched polycarbonate (based upon a total weight of the sheet), a multiwall sheet having a weight of greater than or equal to about 4.5 kg/m$^2$ can be produced with reduced wall warpage, wall breakage, and non-uniform thickness.

Ranges disclosed herein are inclusive and combinable (e.g., ranges of "up to about 25 wt %, or, more specifically, about 5 wt % to about 20 wt %", is inclusive of the endpoints and all inner values of the ranges of "about 5 wt % to about 25 wt %," etc.). "Combination" is inclusive of blends, mixtures, derivatives, alloys, reaction products, and so forth. Furthermore, the terms "first," "second," and so forth, herein do not denote any order, quantity, or importance, but rather are used to distinguish one element from another, and the terms "a" and "an" herein do not denote a limitation of quantity, but rather denote the presence of at least one of the referenced item. The modifier "about" used in connection with a quantity is inclusive of the state value and has the meaning dictated by context, (e.g., includes the degree of error associated with measurement of the particular quantity). The suffix "(s)" as used herein is intended to include both the singular and the plural of the term that it modifies, thereby including one or more of that term (e.g., the colorant(s) includes one or more colorants). Reference throughout the specification to "one embodiment", "another embodiment", "an embodiment", and so forth, means that a particular element (e.g., feature, structure, and/or characteristic) described in connection with the embodiment is included in at least one embodiment described herein, and can or can not be present in other embodiments. In addition, it is to be understood that the described elements can be combined in any suitable manner in the various embodiments.

While the sheeting have been described with reference to exemplary embodiments, it will be understood by those skilled in the art that various changes may be made and equivalents may be substituted for elements thereof without departing from the scope. In addition, many modifications may be made to adapt a particular situation or material to the teachings of the sheeting without departing from the essential scope thereof. Therefore, it is intended that the invention not be limited to the particular embodiment disclosed as the best mode contemplated for carrying out this invention, but that the invention will include all embodiments falling within the scope of the appended claims.

What is claimed is:

1. A multiwall sheet, comprising:

main layers and transverse walls, wherein the main layers comprise outerwalls;

a total thickness of greater than or equal to 45 mm; and/or a weight of greater than or equal to 4.5 kg/m$^2$; and/or greater than or equal to 8 cells located in a straight line between the outerwalls, wherein the line is perpendicular to the outerwalls and a U-value of less than or equal to 1.2 W/m$^2$K; and greater than 75 wt % branched polycarbonate resin, based upon a total weight of the multiwall sheet; and wherein the total thickness of the multiwall sheet varies by less than or equal to 2% from an average total thickness, and wherein the average total thickness is determined over an area of 1,200 mm width by 4,200 mm long using at least 10 data points across the width, and/or adjacent main layers will vary by less than or equal to 20% from an average adjacent layer average thickness wherein the average adjacent layer thickness is determined over an area of the adjacent layers of 1,200 mm width by 4,200 mm long using at least 10 data points across the width.

2. The multiwall sheet of claim 1, wherein the branched polycarbonate was formed using a branching agent selected from the group consisting of phloroglucin; phloroglucid; 1,1,1 -tri(4-hydroxyphenyl)ethane; trimellitic acid; trimellitic trichloride; pyromellitic acid; benzophenonetetracarboxylic acid and acid chlorides thereof; 2,6-bis(2-hydroxy-5-methylbenzyl)-4-methylphenol and 1,3,5-tri(4-hydroxyphenyl)benzene, and combinations comprising at least one of the foregoing branching agents.

3. The multiwall sheet of claim 2, wherein the branching agent selected from the group consisting of 1,1,1-tri(4-hydroxyphenyl)ethane; trimellitic trichloride, and combinations comprising at least one of the foregoing branching agents.

4. The multiwall sheet of claim 1, wherein the multiwall sheet comprises greater than or equal to 90 wt % branched polycarbonate resin.

5. The multiwall sheet of claim 1, wherein the branched polycarbonate comprises greater than or equal to 0.3 mol % branching, based upon 100 moles of branched polycarbonate.

6. The multiwall sheet of claim 5, wherein the branched polycarbonate comprises 0.3 mol % to 0.5 mol % branching, based upon 100 moles of branched polycarbonate.

7. The multiwall sheet of claim 1, wherein the total thickness of the multiwall sheet varies by less than or equal to 1.25% from the average total thickness, and/or the adjacent main layers vary by less than or equal to 15% from the average adjacent layer average thickness.

8. A multiwall sheet, comprising:
main layers;
transverse walls; and
dividers;
wherein the multiwall sheet comprises a total thickness of greater than or equal to 45 mm, and greater than 75 wt % branched polycarbonate resin, based upon a total weight of the multiwall sheet.

9. The multiwall sheet of claim 8, wherein the total thickness of the multiwall sheet is greater than or equal to 50 mm.

10. The multiwall sheet of claim 8, wherein the branched polycarbonate comprises greater than or equal to 0.3 mol % branching, based upon 100 moles of branched polycarbonate.

11. A multiwall sheet, comprising:
main layers;
transverse walls; and
dividers;
wherein the multiwall sheet comprises a weight of greater than or equal to 4.5kg/$m^2$, and greater than 75 wt % branched polycarbonate resin, based upon a total weight of the multiwall sheet.

12. The multiwall sheet of claim 11, wherein the branched polycarbonate comprises greater than or equal to 0.3 mol % branching, based upon 100moles of branched polycarbonate.

13. The multiwall sheet of claim 11, wherein the weight is greater than or equal to 5.0 kg/$m^2$.

14. The multiwall sheet of claim 11, wherein the weight is 4.5 kg/$m^2$ to 6.0 kg/$m^2$.

15. A multiwall sheet, comprising:
main layers comprising outerwalls;
transverse walls; and
dividers;
wherein the multiwall sheet comprises greater than or equal to 8 cells located in a straight line between the outerwalls, wherein the line is perpendicular to the outerwalls, a U-value of less than or equal to 1.2 W/$m^2$K, and greater than 75 wt % branched polycarbonate resin, based upon a total weight of the multiwall sheet.

16. The multiwall sheet of claim 15, wherein the multiwall sheet comprises greater than or equal to 10 cells located in a straight line between the outerwalls, wherein the line is perpendicular to the outerwalls and the U-value is less than or equal to 1.2 W/$m^2$K.

17. The multiwall sheet of claim 15, wherein the multiwall sheet comprises greater than or equal to 90 wt % branched polycarbonate resin.

18. The multiwall sheet of claim 17, wherein the multiwall sheet comprises about 98 wt % branched polycarbonate resin.

19. The multiwall sheet of claim 15, comprising a weight of greater than or equal to 4.5 kg/$m^2$ and a total thickness of greater than or equal to about 45mm.

20. A method for producing a multiwall sheet comprising:
extruding polycarbonate resin to form the multiwall sheet having main layers and transverse walls, wherein the main layers comprise outerlayers;
wherein the multiwall sheet is straight and comprises
a total thickness of greater than or equal to 45 mm; and/or a weight of greater than or equal to 4.5 kg/$m^2$; and/or greater than or equal to 8 cells located in a straight line between the outerwalls, wherein the line is perpendicular to the outerwalls and a U-value of less than or equal to 1.2 W/$m^2$K; and
greater than 75 wt % branched polycarbonate resin, based upon a total weight of the multiwall sheet.

* * * * *